United States Patent [19]

Patterson

[11] 4,157,175

[45] Jun. 5, 1979

[54] DELEAVING AND TRIMMING MACHINE WITH IMPROVED ARRANGEMENT FOR ADJUSTING SPEED AND TORQUE OF ROLL

[76] Inventor: Lawrence B. Patterson, R.D. #3, Cochranton, Pa. 16314

[21] Appl. No.: 709,115

[22] Filed: Jul. 27, 1976

[51] Int. Cl.[2] ..... B65H 41/00

[52] U.S. Cl. ..... 270/52.5

[58] Field of Search ..... 270/52.5, 61 F; 101/226-228; 197/133 F, 134

[56] References Cited

U.S. PATENT DOCUMENTS 3,744,786 7/1973 Patterson ..... 270/52.5

3,829,080 8/1974 Braen ..... 270/61 F

*Primary Examiner*—Robert E. Bagwill

*Assistant Examiner*—A. Heinz

*Attorney, Agent, or Firm*—Charles L. Lovercheck

[57] ABSTRACT

A machine is disclosed for trimming the edges, removing carbon paper from several webs of forms having carbon paper between them, rolling the carbon paper on a single roll, and refolding the forms. A mechanism on the machine directs the carbon paper sheets to the roll and connects the spikes on the reel which holds the ends of the carbon paper in place while it is rolled. The carbon paper is assisted to the carbon reel by a unique pneumatic mechanism.

21 Claims, 22 Drawing Figures

DELEAVING AND TRIMMING MACHINE WITH IMPROVED ARRANGEMENT FOR ADJUSTING SPEED AND TORQUE OF ROLL

STATEMENT OF INVENTION

This invention relates to handling machines and more particularly, to a paper handling mechanism in a folding, deleaving and trimming machine.

REFERENCE TO PRIOR ART

The machine disclosed is an improvement of the machine shown in my U.S. Pat. No. 3,744,786 granted July 10, 1973.

OBJECTS OF THE INVENTION

It is an object of the invention to provide an improved combination folding, deleaving and trimming machine.

Another object of the invention is to provide a machine for separating plies of carbon and paper which is simple in construction, economical to manufacture, and simple and efficient to use.

Another object of the invention is to provide an improved folding device on a trimming and deleaving machine.

Another object of the invention is to provide an improved pneumatic mechanism for assisting the carbon paper to a carbon paper reel.

Another object of the invention is to provide an improved carbon paper reeling device in a deleaving machine.

With the above an other objects in view, the present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 2:
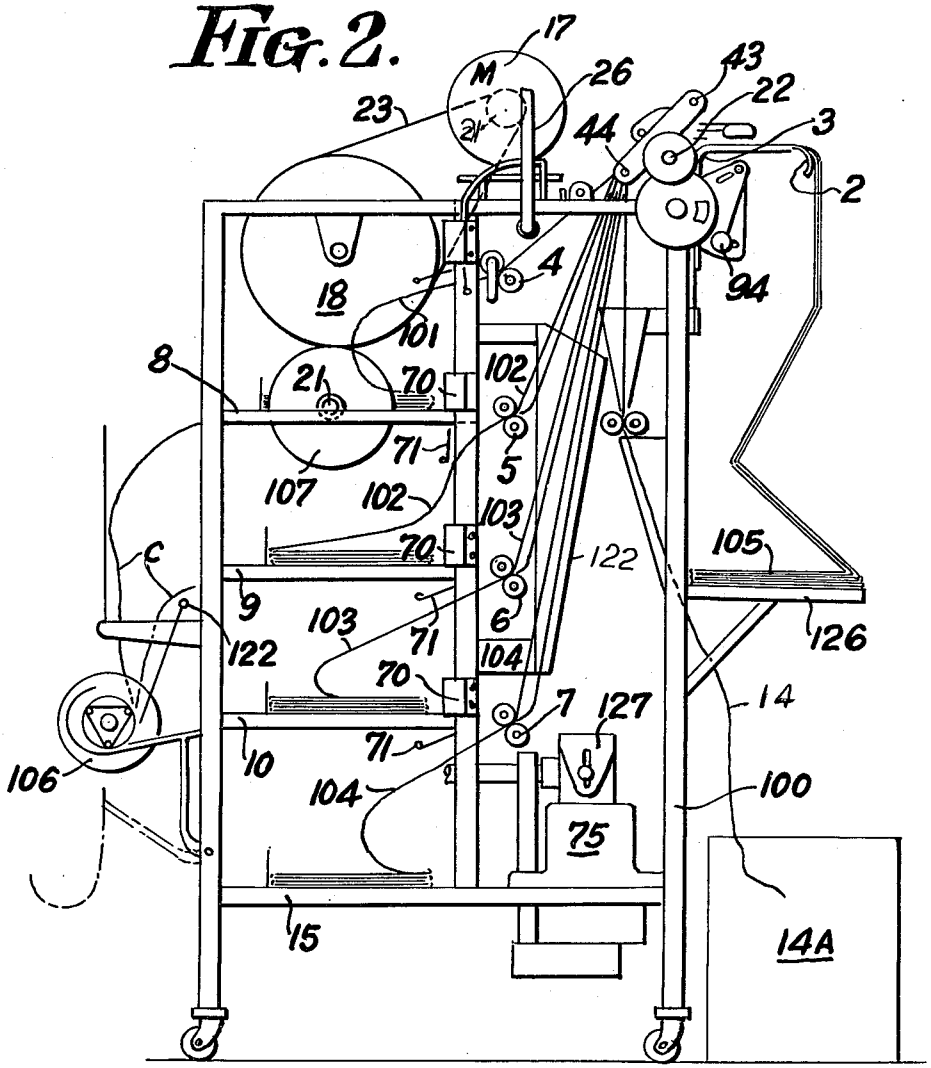
FIG. 2 is a side elevation view taken at right angles to FIG. 1.

The purpose of this machine is to separate the continuous sheets 101, 102, 103 and 104 of paper forms 105 and to separate the sheets of carbon paper from between them, to refold the sheets of paper and to wind the carbon paper on a single roller.

The machine shown has a frame 100 which may be supported on suitable casters as shown. The frame is shown having, for example, four shelves 8, 9, 10 and 15 which may separate a four-ply form made up of plies 101, 102, 103 and 104 of form 105.

Figure 8:
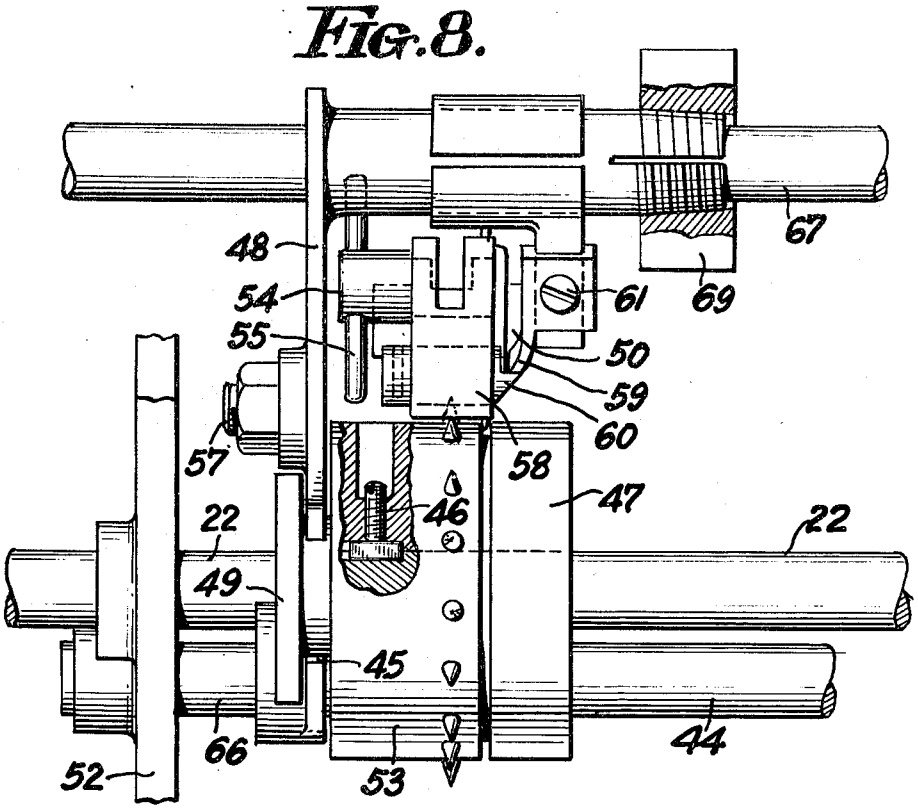
FIG. 8 is an enlarged partial view of the trimming machine taken at right angles to FIG. 7.
Figure 11:
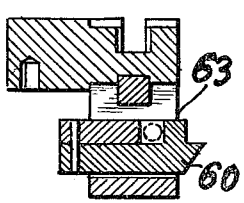
FIG. 11 is a sectional view of the trimming mechanism taken on line 11—11 of FIG. 10.
Figure 7:
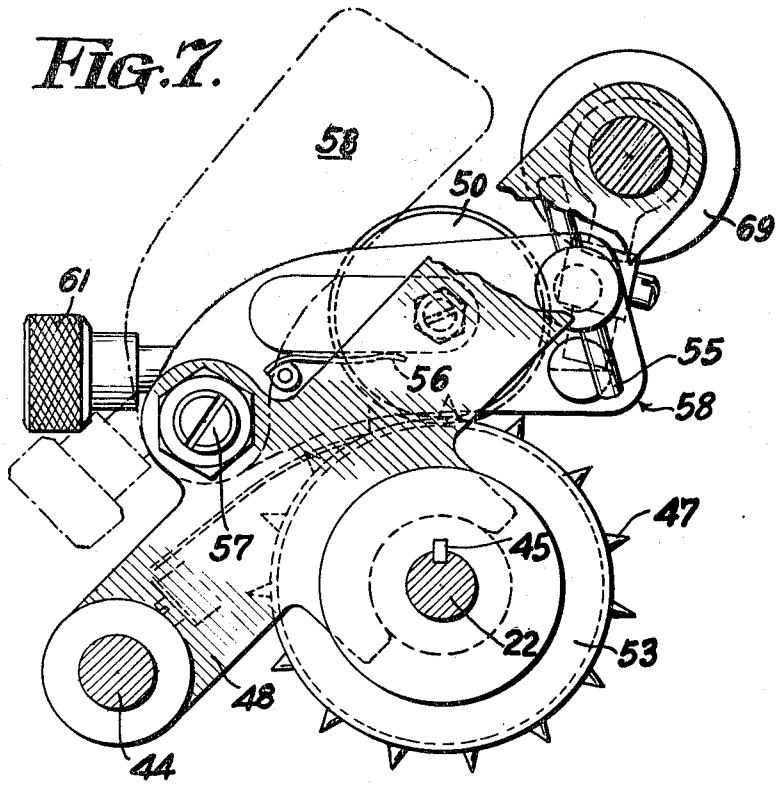
FIG. 7 is an enlarged vertical partial side view of one of the trimmer wheels.
Figure 9:
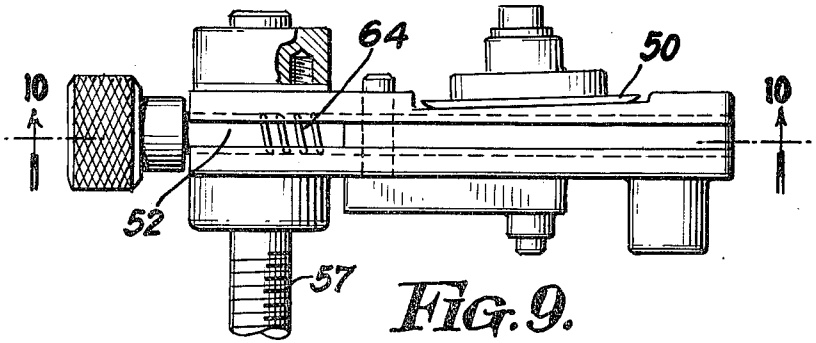
FIG. 9 is a top plain view of part of the trimming mechanism.

The form 105 comes off the folded stack on shelf 126 and is trimmed by the trimmers shown in FIGS. 7 and 8. The trimmed strip 14 is collected in container 14A. The separate plies C of carbon paper and paper sheet 101, 102, 103, and 104 pass between sets of driven rolls 4, 5, 6 and 7 which are driven by the belt 24 which in turn is driven off the sprocket shaft by the belt 23 from pulley 21. The separated continuous sheets are urged downward and caused to stack on shelves 8, 9, 10 and 15 by the folding blades 71.

Figure 1:
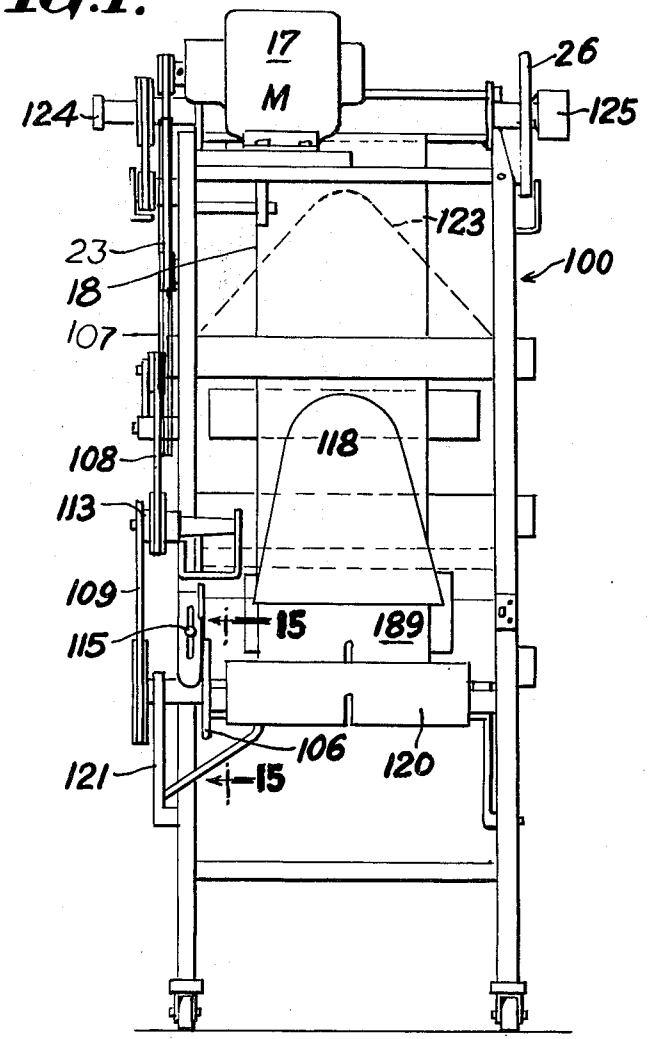
FIG. 1 is a front elevation view of the machine according to the invention.

Referring to FIGS. 1 and 2, the paper from the supply on the paper holder shelf 126 is drawn up over guides 2 and 3 and over the feed sprocket 53 in FIGS. 2 and 7. The surface speed of the rollers 4, 5, 6 and 7 is greater than the speed of the feed sprocket 53 so that there is a slight slippage of the rollers on the paper. The trim strip 14, cut off by the trim cutter discs 50, and the trimmed edges are collected in container 14A. Either side of the form may be trimmed off, or both sides may be trimmed off as desired.

DRIVE

The motor 17, which may be a conventional type of a fractional horespower electric motor, drives the large pulley 18 through belt 23. The small pulley 21 drives the feed sprocket shaft 22. The pulley 21 drives the sprocket shaft 22 which drives the belt 24. The belt 24 is adjusted by the idler pulley 25 which is slidably supported on a bracket on the side of the machine in a manner shown that is well known to those skilled in the art.

The feed sprocket 53 is started and stopped by lever 26. As lever 26 is moved forward the idler pulley 25, carried on the belt support lever 28, is moved downward and tightens the belt 23, as shown by the dotted lines in FIG. 3. This lever 26 as shown in FIG. 5 is held in position and prevented from slipping on quadrant 29 by spring 30.

TRIMMERS

Figures 3, 4, 5, 6:
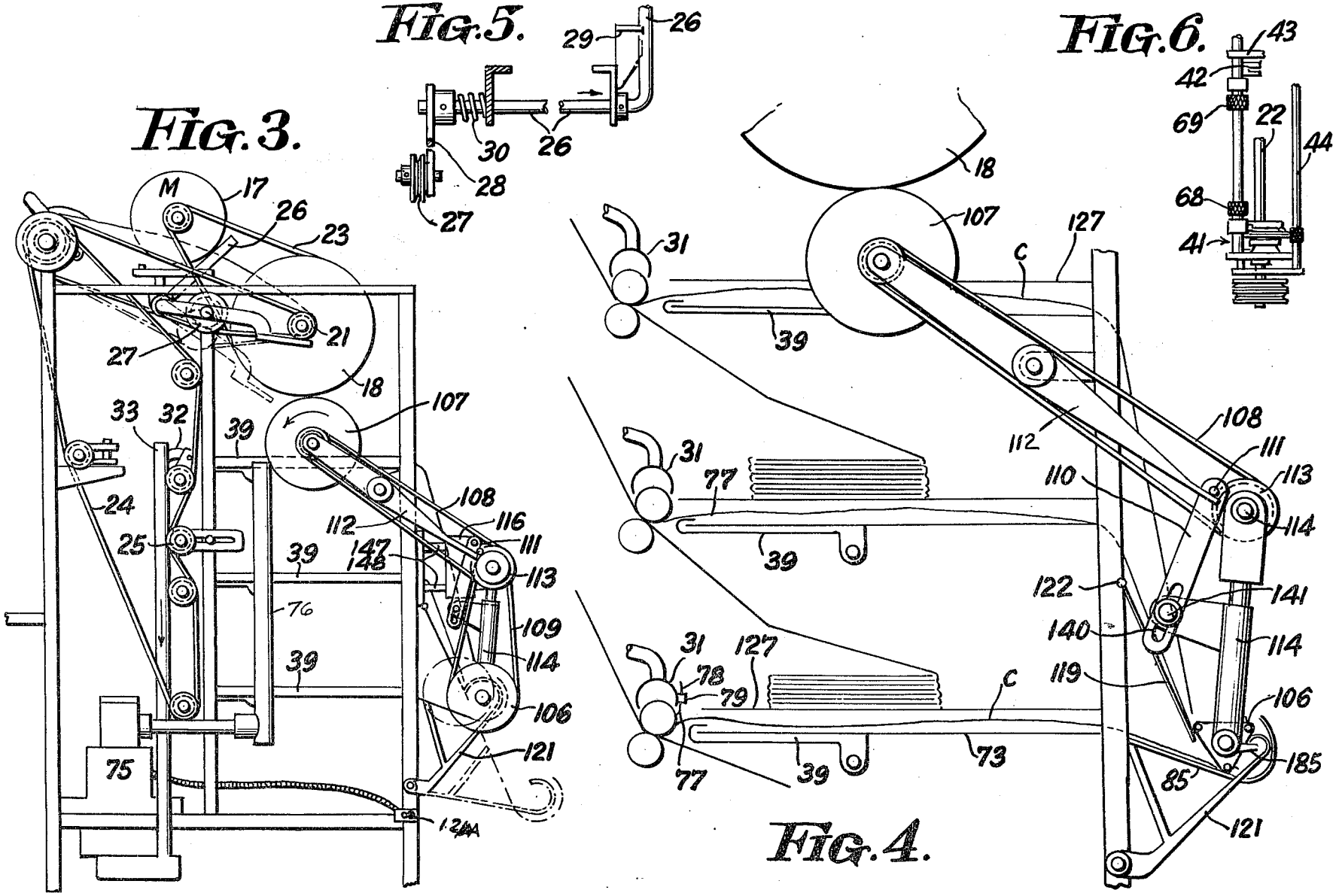
FIG. 3 shows a view of the machine taken from the side opposite to FIG. 2.
FIG. 4 is an enlarged partial side view of the carbon winding and restacking mechanism.
FIG. 5 is a partial view of the control lever for starting and stopping the machine.
FIG. 6 is a partial top view of one of the trimmer wheels and sprocket shaft.
Figure 10:
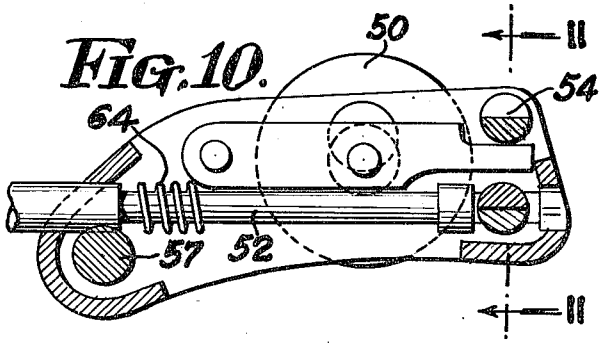
FIG. 10 is a cross-sectional view taken on line 10—10 of FIG. 9.

The right and left hand trimmers 41 and 42 in FIGS. 2 and 6 are shown in the fragmentary view of FIG. 6 and can be adjusted on the bars 43 and 44 to different width forms. The feed sprocket 53 is driven by a key 45 on shaft 22 and held in place by set screw 46. The paper forms are fed through the trimmers by pins 47 on the feed sprocket. These pins 47 engage the punch holes in the edges of the forms. The feed sprocket 53 is also guided by side rail 48 engaging slot 49. The trimming discs 50 are held in trimming position by cam 54 as shown in FIG. 10 and is also shown in trimming position in FIG. 7 by the pin 55 pointing down. When the pin is in the upward position, as shown by dotted lines, the cam 54 will allow the disc to rise out of the trimming position against the force of spring 56. This cam 54 has stops and can only be rotated to the right for trimming. The trimming body 58 which pivots on screw 57 will be raised to the dotted line position in order to rotate the cam 54 because pin 55 cannot be rotated to the right since it will engage side rail sleeve 48. This is a safety feature which prevents damaging the trimming disc.

Raising the trimming body 58 facilitates placing the forms on the feed sprocket pins and adjusting the trimmers to suit the width of the form. FIG. 8 shows the trimming body 58 held in operating position by latches 59 and 60. The trimmer can only be released by rotating knob 61 which causes the crank pin 63 to slide latch bolt 60 to the disengaged position.

Figure 18:
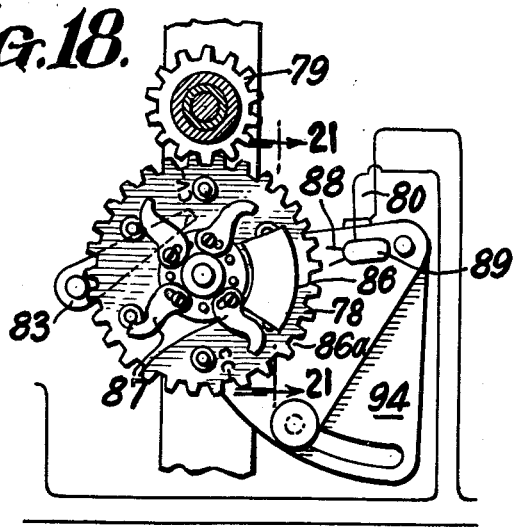
FIG. 18 is a cross sectional view taken on line 18—18 of FIG. 19.
Figure 22:
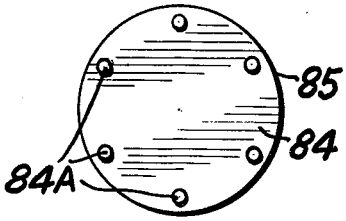
FIG. 22 is an end view of FIG. 19.

In operation, referring to FIG. 18, the forms are placed on the pins in the trimmers with the edge of the paper on top center. If the edge of the paper has been parted at a concave fold, the gear 78 should be engaged with gear 79 when the CC mark lines up with arrow 86*a* and if the edge of the paper has been parted at the convex fold, the mark CV should line up with the arrow. This will cause the solenoids 70 to be actuated at the right time to fold the paper forms on shelves 8, 9, 12, and 15. These gears have the correct ratio to cause gear 78 to make one complete revolution for every two forms that pass through the trimmer.

FOLDING

Figure 19:
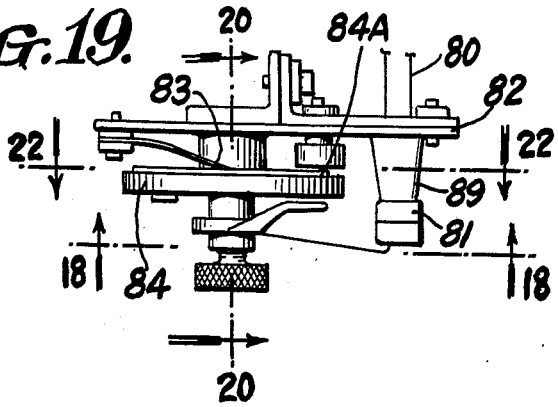
FIG. 19 is a top view of the timing mechanism.
Figure 21:
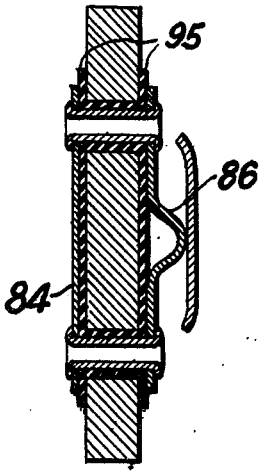
FIG. 21 is a cross sectional view taken on line 21—21 of FIG. 18.

Referring to FIG. 19, wire 80 carries current to contact blade 83 through wire guides 81 and 82. The blade 83 contacts disc 84 and current passes through the rivets 84A to the contact point 86 and to the blade 87, once each revolution of gear and through wire 88 to removable plug and socket 89 and then to solenoid 70.

The blade holder 90 will have a blade 87 for each folder or solenoid on the machine. The blades on the blade holder will be adjusted to actuate the solenoid and thereby swing blades 71 at the right time to swing blades 71 down to fold the plies of forms 101, 102, 103 and 104 on shelves.

Figure 20:
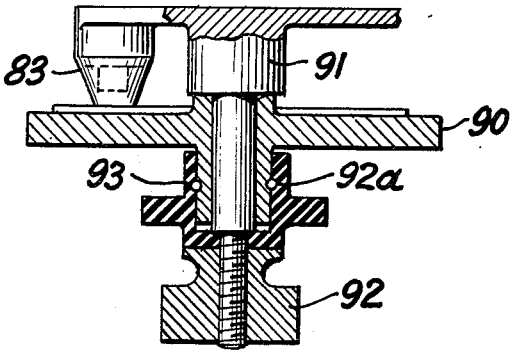
FIG. 20 is a cross sectional view taken on line 20—20 of FIG. 19.

The assembly of gear 78 and blade holder 90 is removed from stud 91, FIG. 20, by unscrewing nut 92 when it is necessary to use another assembly for different length forms. Each assembly remains intact when removed from the stud because of pin 92*a* engaging annular groove 93. The blade holder 90 is made of insulating material.

By loosening screw 92, gears of different size can be substituted for gear 78 and made to mesh with gear 79. The electrical parts are insulated from gear 78 by insulation 95.

When the solenoids 70 are actuated, the blades 71 swing down and force the form to fold along its dotted line to cause it to stack properly on its respective shelf.

Each upper drive roll 81 of the three lower sets of rolls 5, 6, and 7 is hollow and has a vacuum chamber 31 closed at its bottom by suction shoe 13, "U" shaped in cross section, which rests on the upper roll 81 (FIG. 12) and has an opening 51 at each side. Suction shoe 31 is connected to the intake of the blower 75 in FIG. 3 by flexible hose 32 and tube 33. The suction shoe 31' is closed having slots 31''.

The openings 51 overlie the multiple holes 16 which are at that time under opening 51 in the upper side of the roller 81 shown. Air is drawn into the holes 16 in the bottom and out the holes 16 at the top of roll 81, causing the carbon to cling to the lower part of the upper roll 81. As the roll continues to rotate and carbon moves up, the fingers 77 strip the carbon from the roll 81 and guides the carbon over the air jets 39. The flanges on rod 35 which are held to bearing flange 40 by two screws 36' on each side of the machine holds the suction shoe 31' in position and shoe 31 is supported by rod 35.

The bearing bracket for each set of rolls 5, 6, and 7 is held to the machine by yoke 36A which is attached to the machine by screw 20 and the upper bearing brackets which are bolted directly to the frame of the machine. The bearing for lower roll in the three lower sets of rollers are supported on each end by yokes 36A which allows the bearing brackets to swing toward the machine to the angle shown. Part of the yoke is shown away in FIG. 13. The bearings are slotted at 80' to fit in slot of a bearing bracket which allows them an up or down movement. There is pressure applied to the upper roller bearing by spring 11. Cams 37A, one on each side of the machine connected to rod 37 which extends through the bearing bracket, between bearings. The cam 37A may be rotated causing the upper bearing to rise and separate rollers 81 and 82.

All the rollers are the same size. The upper roller 81 is driven by gears 38. The ratio of the gears causes the roller 81 to rotate at a lower speed than roller 82 which causes the upper roller that contacts the carbon paper to have a reverse slippage on the paper, this counteracts the pull of the reel on the carbon paper and eliminates or lessens the tension on the paper between the rollers and the feed sprockets, which prevents separation of the forms as they enter the feed sprockets.

Air jets 39 are located adjacent to the upper roller of each of the sets of rollers 5, 6, and 7. One of the air jets 39, located at each shelf 9, 10, and 15, forms part of carbon-separating plate 73. Air inlet 34 is connected to air pressure tube 76 (FIG. 3). The jets project air along and under the free end of the carbon paper ply C and "float" it along to the points 117 of the reel. The form guide 76A guides the paper web 107 and facilitates folding the forms after they have been separated from the carbon paper. The bronze strippers 77 are made to bear against the upper roller 81 by springs 78.

Figures 12, 13, 14, 15, 16, 17:
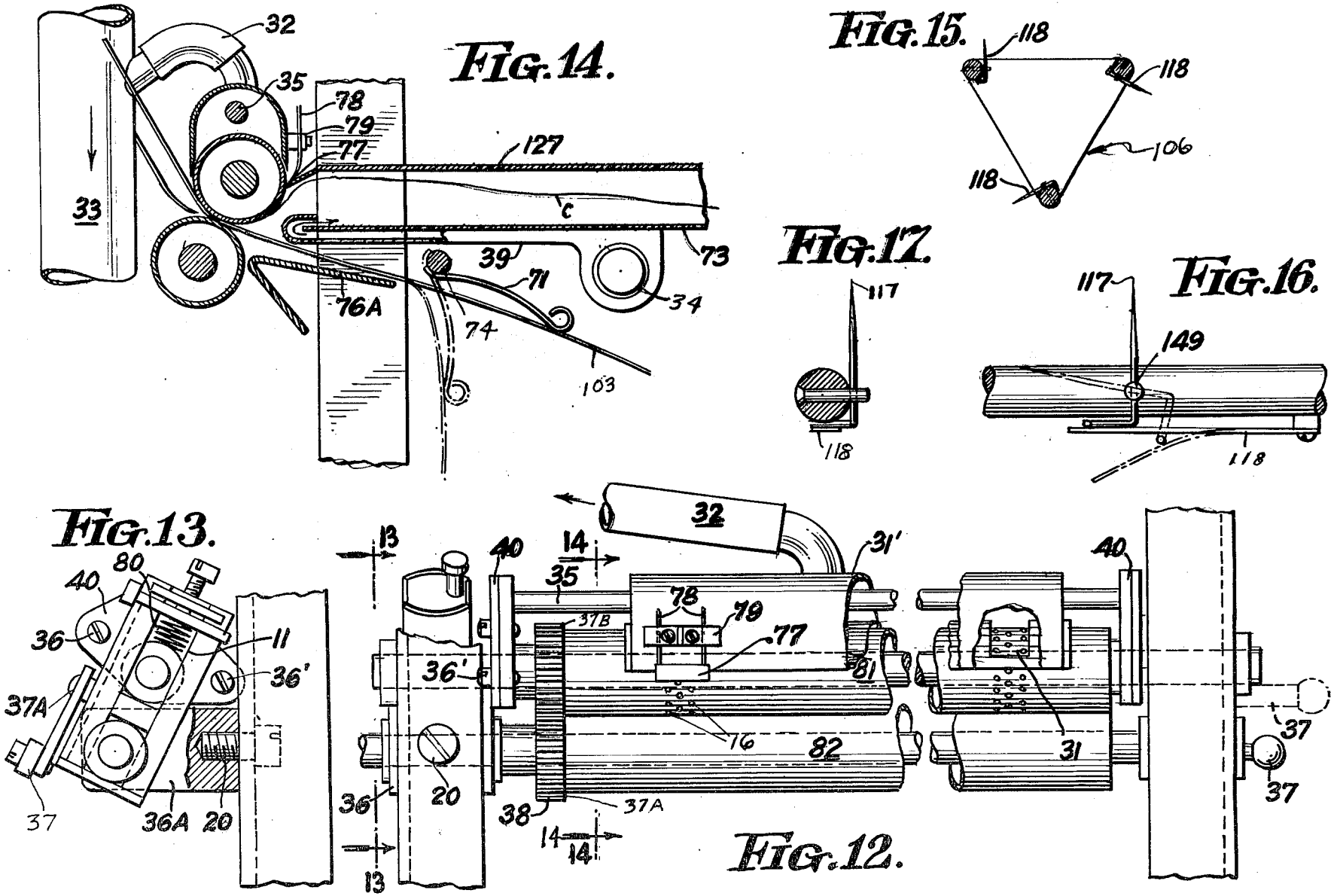
FIG. 12 is a front view of a set of rollers showing the suction shoe.
FIG. 13 is an end view of FIG. 12 taken on line 13—13 showing bearing bracket and roller separating cam.
FIG. 14 is a cross sectional view taken on line 14—14 of FIG. 12.
FIG. 15 is a cross sectional view of the carbon reel.
FIG. 16 is an enlarged view of a part of the carbon reel.
FIG. 17 is an end view of FIG. 16.

Referring to FIGS. 1, 3, and 4, the reel 106 is driven by friction wheel 107 through belts 108 and 109. The link 110 has a pin 111 on the upper end which projects outward over rocker arm 112. Part of pulley 113 is broken away in FIG. 3 to show pin 111. Reel bearing arm 114 is swingably supported on shaft 114'. It is also telescopically adjustable. It is pivoted from shaft-supporting pulley 113 by yoke 114A which is part of arm 114. This telescoping feature allows belt 109 to be adjusted and held in adjustment by clamping screw 115. The arm also has a bracket that supports link 110. This link is adjusted to keep the reel pivoted towards the machine a few degrees as pin 111 bears against the upper edge of rocker arm 112 and friction wheel 107 bears against the belt of pulley 18. Thus, by adjusting link 110 in slot 140 by clamping bolt 141, the weight of reel 106 can be made to put pressure on friction wheel 107 and give sufficient torque to wind carbon on the reel. As tension becomes too great on the carbon, the lower carbon will pull reel 106 in towards the machine causing arm 114 to swing toward the machine and reduce the pressure on friction wheel 107 and slow the speed of the reel 106 or stop it, depending on the tension of the carbon. Pulley 113 rotates on a shaft that is clamped in head 116, which is a sliding, fit on two rods 147 and 148 bolted to the frame of the machine. Belt 108 may be adjusted by moving head 116 on rods 147 and 148 when the belt is to be adjusted. As the carbon sheet on each pair of rolls is floated along by air from jet 39, it encounters guide 119–120 which pulls the carbon into engagement with spikes 117 (FIG. 16). The carbon is caused to wind on the reel by being impaled on one or more sharp points 117 on the rods that make up the reel. Points 117 pivot from holes 149, drilled and countersunk in rods, and are held square with the rods by springs 118. The points are held in this position while carbon is being wound on the reel, but when the carbon is being pulled off, they release the carbon by pivoting to the position shown by dotted lines. There are two carbon guides, 119 and 120. The guides 119 and 120 have slots that clear the points as the reel rotates and cause the points to pierce the carbon. Two slots 120A are shown in FIG. 1.

To start the carbon winding operation, carbon guide 120 is held in place by arm 121 (FIG. 4) which is hooked over the lug or projection on the reel bearing. The lower carbon controls the operation of the reel. As it reaches sufficient tension, the reel is pulled towards the machine, which slows the reel down by reducing pressure on the friction wheel, and, if the carbon stops, the wheel stops before the carbon is torn apart. The upper carbons reach the reel before the lower carbon and are caused to wind on the reel by guide 119 (FIG. 2) which prevents them from interferring with the lower carbon. After all three carbons have started to wind on the reel, the machine is stopped or slowed down by lever 26 which causes the reel to swing toward the machine and unhooks the carbon guide that drops down and trips switch 121A, stopping the blower since suction is no longer needed to separate the carbon, and the reel is then free to wind the carbon to full capacity. Guide 119 pivots from 122 to the position shown in FIG. 2 by a suitable coil spring.

There are form guides adjacent feed sprocket bar 44 (FIGS. 2 and 6) which guide the forms and the carbon into the rollers. These guides are supported by two brackets 122 of which one is shown in FIG. 2, and the shape or form of the upper postion of the guides 123 are shown by dotted lines 123 in FIG. 1.

An overriding clutch 124 (FIGS. 1 and 3) is on sprocket shaft 22. It is a conventional spring-type overriding clutch and allows the feed sprockets to be rotated independently by hand so that the forms can be fed through the sprockets to the form guide by knob 125 (FIG. 1). This type of clutch has a certain drag, and it is impossible for the sprockets to be rotated by the light pull of the forms and to overcome the drag of the clutch.

OPERATION

Starting with the lower form, the forms with carbon are fed consecutively into their guides. The upper roller separating rod 37 with cams 37A (FIG. 12) is pulled out, and the upper roller raised, then the form fed through the rollers and the rollers are released. With carbon guide 120 (FIG. 1) in raised position, the machine is started. The upper rollers will start pulling the forms through the guides until they enter the other rollers. As the three lower forms and carbon enter the rollers, the carbon is made to separate from the forms and cling to the upper roller by suction holes 16 and is stripped off the roller 81 and guided over the air jet by stripping fingers 77 (FIGS. 12 and 14). The carbon is then carried to the back of the machine by air pressure from jet 39 where it is wound on the reel 106 while the forms are folded on their respective shelves.

The folding blades 71 are attached to crank rods 74 and solenoids 70 by suitable connecting rods.

Referring to FIG. 2, the cover 127 over the outlet of the blower can be adjusted to lower it to increase air pressure, or raised to increase suction.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A machine for separating folded sheets of a continuous web of paper and made up of layers of paper and for refolding said paper comprising, means to support a stack made up of first paper layers and a second paper layer disposed between said first paper layers, positive means to drive said web, spaced aligned pairs of rolls receiving at least two said first layers of paper and one said second layer of paper therebetween, means driving said rolls, a single reel supported on said machine in spaced relation to said rolls for winding said second layer thereon, and means to reduce the speed of rotation on said reel relative to the speed of said rolls as the diameter of said second paper layers wrapped on said reel increases, said reel comprising, spaced rods extending axially of said reel, said rods having spikes supported at intermediate parts thereon at right angles to the axis of said rods, and spring means urging said spikes to remain in said position at right angles to said rod whereby web materials supported on said rods may be held by said spikes and wound around said rods.

2. The machine recited in claim 1 wherein second sheets in a web form comprise carbon paper.

3. The machine recited in claim 1 wherein said rolls comprise an upper roller and a lower roller and means on said machine is provided whereby the rolls are driven such that the surface of the upper roller is slower than the lower roller.

4. A machine recited in claim 1 wherein one roll of a first pair of said pair of rolls has circumferentially spaced holes extending therethrough and a suction shoe having a slot, said shoe being generally U-shaped in cross section, supported over said roll having holes therein, and suction means connected to said suction shoe wherein air is drawn through said slot in said shoe causing carbon to cling to said roll thereby separating said second layer from said web.

5. The machine recited in claim 4 wherein one of said first rolls has a stripper member fixed to said suction shoe and said one of said first rolls is an upper roll and is hollow and said hollow roll has multiple holes extending from the outside to the inside thereof whereby air drawn through said roll by said shoe draws said second sheets toward said roll thereby separating said second sheets from said first sheets.

6. The machine recited in claim 5 wherein the first rolls each have a vacuum shoe on the side of said upper roll remote from said paper sheet, said vacuum shoe being connected to an intake of a blower whereby said paper is drawn to said rolls, said vacuum shoe being supported adjacent multiple holes in said upper roll.

7. The machine recited in claim 4 wherein an air jet member is supported adjacent one of said pairs of rolls, said air jet member adapted to direct air away from said rolls and thence onto said said layer coming from said rolls, whereby said carbon is carried to said reel on said air jet.

8. The machine recited in claim 7 wherein said first rolls comprise an upper roll and a lower roll a stripper finger is fixed to a vacuum shoe supported above the upper said roller for directing said paper.

9. The machine recited in claim 7 wherein strip means are supported on said vacuum shoe for removing said carbon paper from said rolls and guiding said carbon over said air jet.

10. The machine recited in claim 9 wherein said air jet is disposed adjacent said rolls onto said carbon after said carbon leaves said rolls, floating said carbon toward said reel.

11. A machine recited in claim 1 wherein said means for reducing the speed of said reel comprises, a yoke and reel arm support swingably connected to said machine and having said reel supported on the distal end of said reel arm, a driven wheel, a rocker arm having an intermediate part, said intermediate part being swingably connected to said machine, crank means engaging said rocker arm, a friction wheel on said rocker arm engaging said wheel thereon, engaging an end of said rocker arm remote from said friction wheel, whereby tension on said second layer being wrapped on said reel is adapted to swing said reel arm, whereby said crank means swings said rocker arm, moving said friction wheel away from said wheel in proportion to the force exerted thereon by said second layer.

12. The machine recited in claim 11 wherein said yoke and said reel arm support are telescopically supported relative to each other.

13. The machine recited in claim 12 wherein a stop member is supported on an arm and said arm is slidably supported on said reel arm.

14. The machine recited in claim 13 wherein said rocker arm has a member thereon adapted to engage said stop member on said reel arm for applying pressure on said friction wheel for winding carbon paper thereon.

15. A machine recited in claim 14 wherein a link is attached to said arm and said link engages a clutch means on said machine for driving said carbon reel and said clutch means is released by said link when said stop member reduces pressure on said frictional wheel.

16. The machine recited in claim 15 wherein said reel arm is inclined toward said machine a few degrees, whereby a pin bears against the stop member on said reel arm and urges the friction wheel aganst a belt driving said reel.

17. The machine recited in claim 1 wherein said spikes are swingably connected to said rods and urged to position for impaling the carbon paper thereon by said springs.

18. A machine for separating carbon paper sheets from form sheets in a web form comprising at least one pair of rolls comprising an upper roll and a lower roll adapted to receive a said form and a said sheet of carbon paper therebetween, means for folding and stacking said forms passing between said rolls, a form guide on said machine adjacent to the rolls for guiding said form, said rolls comprise an upper roll and a lower roll and vacuum means on said upper roll for urging said carbon paper to follow said upper roll, fingers on said machine for directing said carbon paper away from said roll, and an air jet on said machine adjacent said rolls for directing a jet of air away from said rolls and toward a carbon paper reel, whereby said carbon paper is floated towards said reel for threading said machine.

19. The machinery recited in claim 18 wherein said reel has a pointed member on the periphery thereof for impaling said carbon paper thereon.

20. The machine recited in claim 19 wherein a guide member is swingably supported on said machine for guiding said carbon paper toward said point on said reel during the threading operation thereof.

21. The machine recited in claim 20 wherein a plurality of said rolls are provided, and some said upper rolls have a said vacuum means and a said jet associated therewith and said carbon sheet from each said roll is directed to said reel to be rolled thereon.

* * * * *